United States Patent [19]

Hubbard et al.

[11] 4,032,227

[45] June 28, 1977

[54] TONER CONCENTRATION CONTROL APPARATUS

[75] Inventors: James H. Hubbard, Boulder County, Colo.; George W. Van Cleave, Lexington, Ky.

[73] Assignee: International Business Machines Corporation, Armonk, N.Y.

[22] Filed: Jan. 15, 1976

[21] Appl. No.: 649,390

[52] U.S. Cl. ..... 355/14; 118/7; 118/646; 222/DIG. 1

[51] Int. Cl.[2] ..... G03G 15/00; B05B 5/02

[58] Field of Search ..... 355/14, 3 DD; 118/7, 118/9, 637, 646; 222/57, DIG. 1; 427/8

[56] References Cited

UNITED STATES PATENTS

| | | | |
|---|---|---|---|
| 3,354,802 | 11/1967 | Doucette et al. | 355/14 |
| 3,587,521 | 6/1971 | Rubenstein et al. | 118/7 |
| 3,876,106 | 4/1975 | Powell et al. | 222/57 |
| 3,892,672 | 7/1975 | Gawron | 355/3 DD |

*Primary Examiner*—L. T. Hix
*Assistant Examiner*—J. A. LaBarre
*Attorney, Agent, or Firm*—Francis A. Sirr

[57] ABSTRACT

A xerographic copying apparatus having a developer operable to present a two component developer mix, i.e. carrier and toner, to the photoconductor's latent electrostatic image, and apparatus for automatically adding virgin toner to the developer as the toner concentration is depleted as a result of toning the photoconductor's image over a period of making a number of copies. Once the need to add toner is indicated, a known, unit quantity of toner is added to the developer. Immediately thereafter, the ability to sense toner concentration is inhibited until the next two photoconductor images have been toned. In the event that low concentration is sensed immediately thereafter, another unit quantity of toner is added, and sensing is again inhibited for the two-copy interval. In the additional event that low concentration is sensed seven consecutive times, each time being separated by a two-copy inhibit interval, a failure latch is set and further operation of the copying apparatus is inhibited. That latter event may be caused by toner exhaustion, failure to feed toner properly, or failure of the concentration sensing means.

25 Claims, 4 Drawing Figures

TONER CONCENTRATION CONTROL APPARATUS

BACKGROUND AND SUMMARY OF THE INVENTION

The present invention relates to the field of electrophotography and particularly to automatically controlling toner concentration in the two-component developer therefor. More specifically, the present invention relates to the xerographic process step of depositing toner on a latent electrostatic image carried by a moving photoconductor, to form a toned, reverse reading, visible image of an original document thereon, and to an improved means of controlling toner concentration, including means operable to add toner a maximum of once every M copies, and to inhibit the copying operation if the need to add toner is indicated N consecutive times, each time including no more than an M copy cycle.

In the xerographic process a toned visual image is transferred to a copy medium, for example to a sheet of copy paper at a transfer station. The toner is usually a pigmented thermoplastic resin. The individual toner particles are formulated such that they will soften under heat. When soft, they firmly stick to the surface of copy paper. The amount of toner used in forming a copy is dependent upon the visual image content of the original documents. Thus, maintaining an accurately controlled toner concentration requires a closed-loop control system which operates to sense actual toner concentration and to add toner when necessary.

Manual prior art systems for controlling toner concentration include a manually settable device for controlling the amount of toner metered to the developer material during each copy cycle. This method of control was based upon the operator's judgment. The operator observed the output copy quality and made a judgment as to whether more or less toner should be dispensed in order to improve the copy quality. Such systems necessarily depend upon the constant presence of the operator.

Various prior art automatic systems have been proposed for controlling toner concentration. These systems rely on measuring a physical characteristic of the developer material such as its electrical resistance, inductance, capacitance, or an optical characteristic.

The present invention provides an improved toner concentration control apparatus which, in effect, allows toner to be added as needed, and indicates a failure if the addition of toner is excessive.

In a specific embodiment of the present invention a first counter operates to integrate a signal indicative of a need to add toner. If, within a given time period, this counter reaches a high-count state, addition of toner is initiated, and the ability to subsequently sense a need to add toner is inhibited for a preset interval, such as a number of copy cycles. After this interval has expired, the ability to again add toner is enabled. A second counter is operable to count the number of uninterrupted, consecutive add-toner occurrences. If the second counter reaches a high-count state, the assumption is made that the copier is unable to properly tone the photoconductor's images, and further copying is inhibited.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
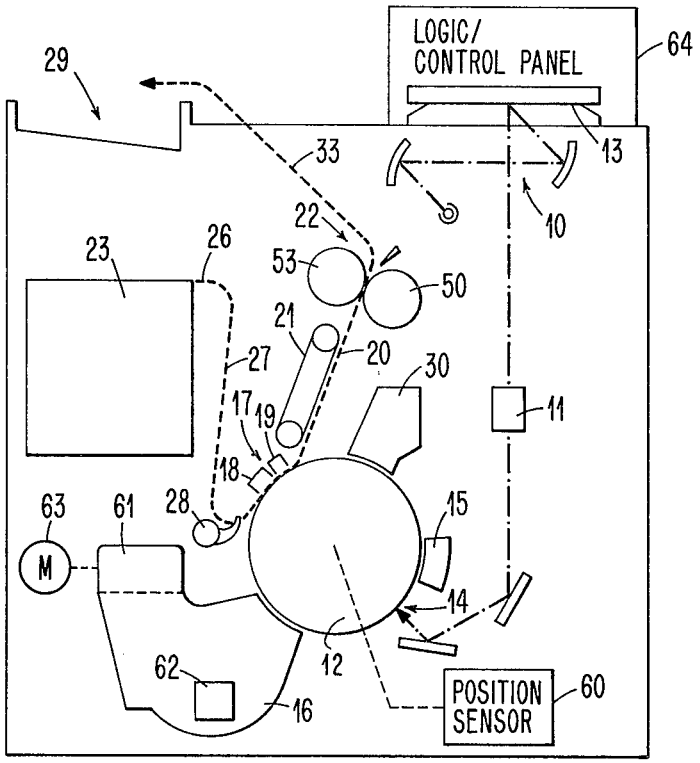
FIG. 1 is a schematic view of a xerographic copying apparatus incorporating the present invention.

FIG. 1 is a schematic view of a xerographic copying apparatus incorporating the present invention. In this copier a scanning mirror system 10 and a moving lens 11 move in synchronism with the rotation of photoconductor drum 12 to place the latent image of an original document 13 onto the drum's photoconductor surface. As is well known, prior to imaging at 14 the drum is charged by corona 15. After imaging, the drum's latent image is toned or developed by developer 16, for example a magnetic brush developer. Thereafter the drum's toned visible image is transferred to a sheet of copy paper at transfer station 17 by operation of transfer corona 18. Sheet detach means 19 operates to cause the leading edge of the now-toned sheet to leave the surface of the drum and to follow sheet path 20, adjacent vacuum conveyor 21 on its way to hot roll fuser assembly 22. After fusing, the finished copy sheet follows sheet path 33 and is deposited in exit tray 29. After transfer, the drum is cleaned as is passes cleaning station 30.

The apparatus of FIG. 1 includes a copy sheet supply bin 23. This supply bin includes a bidirectionally movable elevator which supports the bottom sheet of the stack. While this structure is well known to those of skill in the art, an exemplary structure is described in the IBM TECHNICAL DISCLOSURE BULLETIN of August 1974, at pages 670 and 671. A sheet feeder within the bin is operable to feed the top sheet of the stack to sheet discharge path 26. This sheet then travels down sheet path 27 to be momentarily stopped at alignment gate 28. When the leading edge of the drum's toned image arrives at the vicinity of the gate, the gate is opened to allow the sheet to progress into transfer station 17 in exact registry with the drum's image. An exemplary means of picking the top sheet from the bin is described in the IBM TECHNICAL DISCLOSURE BULLETIN of February 1974, at pages 2966 and 2967.

The construction of the hot roll fuser is well known in the art. Generally, hot roll 50 is heated to an accurately controlled temperature by an internal heater and associated temperature control system, not shown. The hot roll preferably includes a deformable external surface formed as a thin elastomeric surface. This surface is designed to engage the toned side of the copy sheet, fuse the toner thereon, and readily release the sheet with a minimum adherance of residual toner to the hot roll. Such a hot roll is described, for example, in the IBM TECHNICAL DISCLOSURE BULLETIN of August 1973, at page 896.

The nip formed by rolls 50 and 53 is preferably opened and closed in synchronism with the arrival and departure of the leading and trailing edges, respectively, of a copy sheet. This synchronism is achieved by a drum position sensing means 60 which responds to the position of drum 12 and effects opening and closing of the nip by means of a control system, not shown. An exemplary mechanism for effecting the opening and closing of this nip is shown in the IBM TECHNICAL DISCLOSURE BULLETIN of May 1973, at page 3644.

Developer 16 includes a toner replenisher section 61 which is operable, when activated, to add a predetermined quantity of virgin toner to the developer, where it is mixed with the toner-depleted carrier. Arrangements such as this are well known and may be, for example, as described in U.S. Pat. No. 3,572,555 issued to A. H. Knight, or as described in the IBM TECHNICAL DISCLOSURE BULLETIN of September 1972, at pages 1251 and 1252.

Preferably, section 61 includes a sensing means to indicate depletion of the virgin toner. Such a means may be as described in the IBM TECHNICAL DISCLOSURE BULLETIN of September 1973, at pages 1258 and 1259.

Also, associated with developer 16 is a toner concentration sensor 62 which is operable to detect and indicate the need to add toner from section 61. Specifically, such a need results in a predetermined time period of operation of motor 63. Preferably, sensor 62 is of the type described in U.S. Pat. No. 3,756,192 issued to H. C. Locklar, D. C. Tao and L. E. Traver, Jr. Another exemplary form of such a sensor is described in the IBM TECHNICAL DISCLOSURE BULLETIN of September 1972, at page 1258.

In order to assure high copy quality images, it is necessary that the proper toner concentration, i.e. the ratio of toner-to-carrier in the developer material, be maintained. By varying this ratio, for example, by having excessive toner, dark blurred overdeveloped images are obtained. When too little toner is present in the developer material, light underdeveloped images are obtained. in order to automatically control the ratio of toner and carrier and maintain it at a desired level, the device of U.S. Pat. No. 3,756,192 optically views, in a cyclic fashion, a sample of the developer material to determine its light reflectance characteristic. Since the reflectance characteristic of the toner particles differs from that of the carrier particles, a properly proportioned mixture of the developer material will have a predetermined light reflectance characteristic. Since the toner particles are generally darker than the carrier particles, the amount of light reflected becomes greater as the proportion of toner to carrier in the mixture becomes less and, conversely, less light is reflected from the mixture as the ratio of toner to carrier increases.

Figure 2:
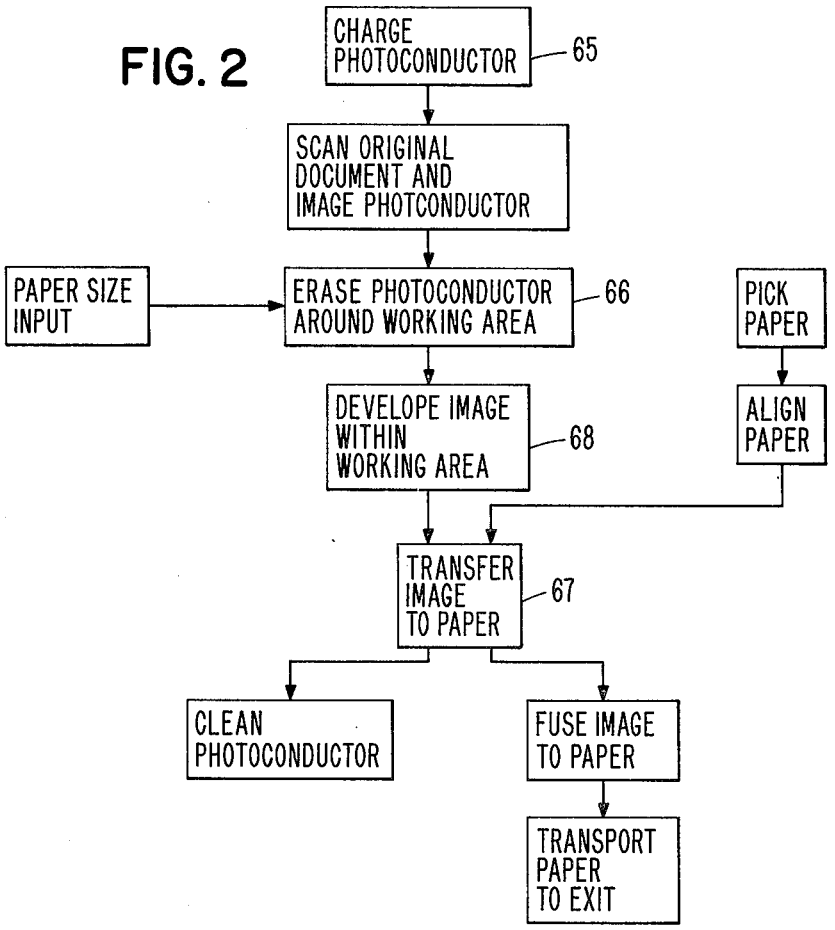
FIG. 2 is a flow-type representation of the xerographic process steps achieved by the copier's logic/-control panel of FIG. 1.

The copying apparatus of FIG. 1 is controlled by logic/control panel 64 in a manner well known to those of skill in the art. This control is depicted in FIG. 2, and is typical of the execution of a single copy request. The first event to occur is that of charging the photoconductor, as at 65. Thereafter, the original document is scanned and a latent electrostatic image thereof is formed on the photoconductor. By definition, that area of the photoconductor which will correspond to a sheet of paper at the transfer station is the working area. Due to the basic electrostatic mechanism of the developing process, it is desirable that the photoconductor be discharged, i.e. erased, in the area around or bordering this working area. Thus, the next process step is that of erasing, as at 66.

At or about this same time, a sheet of paper is picked from bin 23. While the photoconductor's image is developed, as at 68, the sheet of paper is aligned at gate 28 in preparation for transfer.

Thereafter, the photoconductor's toned image and the sheet of paper move through transfer station 17 to transfer the toner to the paper, as at 67.

As the last steps in the process, the photoconductor is cleaned, as the toner is fused onto the paper sheet. The finished copy is not transported to exit tray 29.

Figure 3:
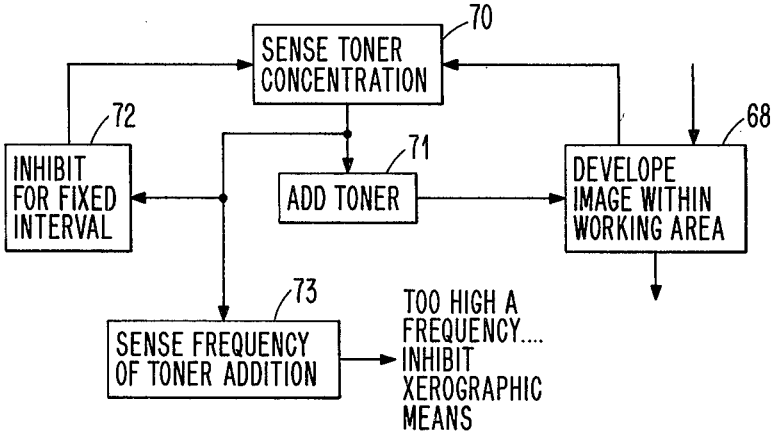
FIG. 3 is a flow-type representation of the present invention, as it cooperates with the developing step of FIGS. 1 and 2, and functions to selectively inhibit the xerographic process.

FIG. 3 discloses the interaction between FIG. 1 and 2's xerographic means and the present invention. A means 70 is operable to sense toner concentration, as this concentration changes due to operation of the xerographic means. A means 71 is controlled to add virgin toner when necessary. The addition of toner to the developer's toner/carrier mix does not immediately result in a mix having a homogenous higher toner concentration. Thus, it is desirable to employ a means 72 to inhibit operation of sensing means 70 for a fixed interval, for example a fixed number of cycles of FIG. 1 and 2's xerographic means. A means 73 senses the frequency at which toner is added, i.e. the amount of toner which means 70 indicates should be added. Preferably, means 73 is reset or times-out whenever means 70 does not indicate a need to add toner immediately after the inhibit operation of means 72 has expired. That is, means 73 is preferably responsive to an uninterrupted indication of a need to add toner for a given interval, and operates to interpret this occurrence as a failure which requires that FIG. 1 and 2's xerographic means be inhibited. This failure condition may result from a number of undesirable conditions, such as for example, complete depletion of toner, failure of sensing means 70, or failure of the developer's toner replenishing device 61.

Figure 4:
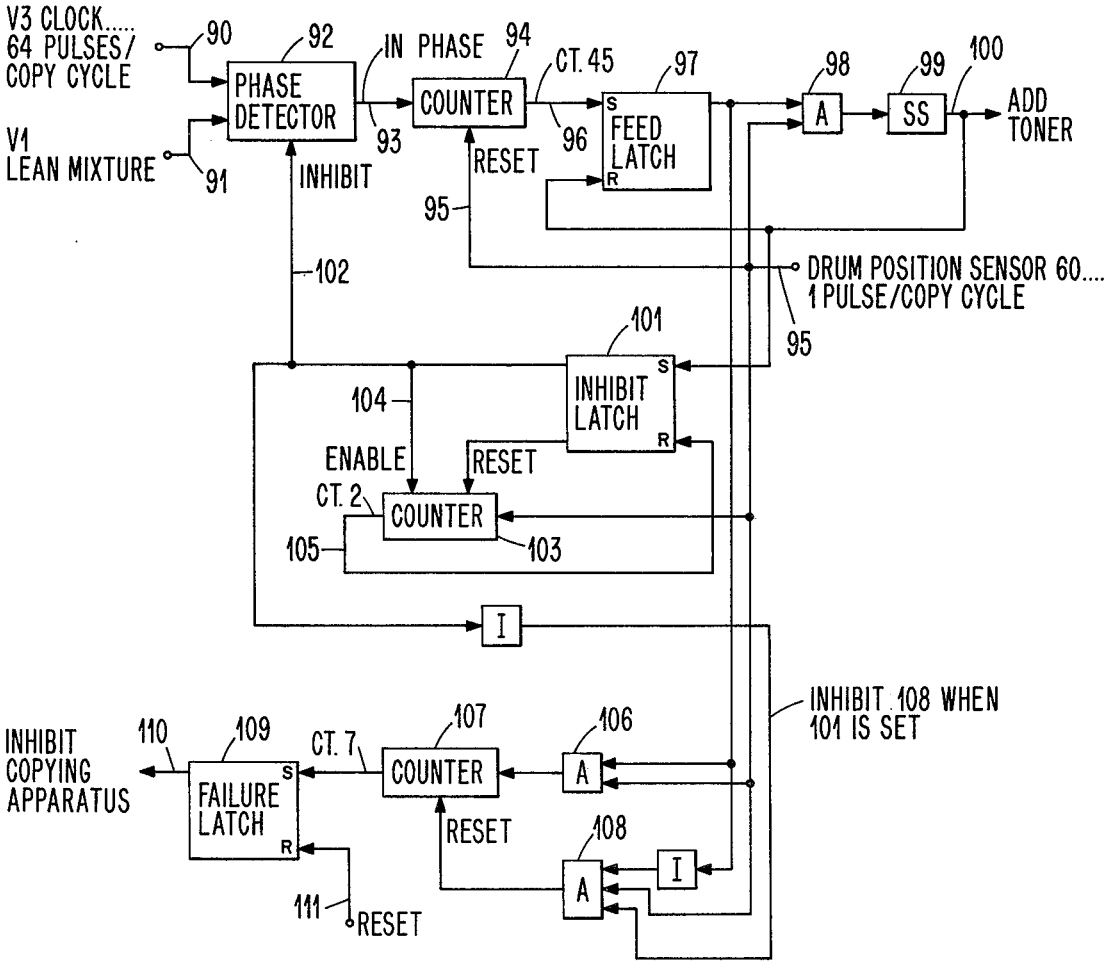
FIG. 4 is a logic diagram representation of the present invention, as it cooperates with a toner concentration sensor as shown in U.S. Pat. No. 3,756,192.

FIG. 4 is a logic diagram representation of the present invention, wherein toner concentration is sensed by the apparatus described in above-mentioned U.S. Pat. No. 3,756,192. Conductor 90 supplies the V3 signal of that patent. This signal, in effect, a cyclic clock signal which is derived from a reed switch associated with developer 16 such as to provide 64 uniformly spaced electrical pulses for each copy cycle. This signal is indicative of the frequency with which toner concentration is sensed. Conductor 91 supplies the V1 threshold detected signal of that patent, this being a cyclic signal indicating a lean mixture, i.e. a signal indicating the need to add toner. These two signals are supplied as inputs to phase detector 92, this phase detector providing an output signal at conductor 93 for each of the 64 V3 pulses during which the V1 signal is in phase with the V3 signal. This phase relationship and the manner in which the phase relationship changes with toner concentration is described in aforementioned U.S. Pat. No. 3,756,192.

Output 93 of the phase detector is supplied to integrating counter 94. In the event that counter 94 reaches a count state of 45 prior to receiving a reset pulse on conductor 95, then, in this event, an output is supplied on conductor 96. The reset pulse, on conductor 95, is supplied from drum position sensor 60, FIG. 1, and comprises a periodic signal wherein one pulse occurs for each copy cycle, as measured by movement of drum 12. Thus, 64 pulses appear on conductor 90 during one copy cycle, i.e. between two adjacent drum position pulses on conductor 95.

Counter 94 operates to integrate the output of phase detector 92 such that noise signals and the like will not cause the addition of toner to developer 16. However, when at least 45 of the 64 V3 clock pulses occur in phase with the V1 lean mixture signal, the feed latch 97 is set. The setting of feed latch 97 provides a first enabling signal to AND 98. On the next drum position pulse on conductor 95, AND 98 operates to trigger single shot 99. Single shot output 100 supplies an "add toner" signal which is operable to energize FIG. 1's motor 63, in much the same manner as the like-designated signal of U.S. Pat. No. 3,756,192 produces the addition of toner to the developer. In the apparatus of FIG. 4, the addition of toner is of a known, unit quantity, as determined by the timing interval of single shot 99, this timing interval being substantially less than than the time between two drum position pulses on conductor 95.

The output signal from single shot 99 is operable to reset feed latch 97.

The output of single shot 99 is also operable to set inhibit latch 101. This latch, when set, inhibits further detection of toner concentration, as by way of conductor 102, and likewise enables inhibit counter 103, as by conductor 104. Counter 103 is now operable to count subsequent drum position sensor pulses on conductor 95, each pulse of which is indicative of one copy cycle of FIGS. 1 and 2. After a given number of copy cycles have been counted, for example two, conductor 105 is operable to reset latch 101. Toner concentration sensing is now enabled, and the possibility exists that feed latch 97 will immediately be set as an indication that the developer mix remains "lean".

It will be remembered that feed latch 97 in its set condition and the coincidence of a drum position pulse on conductor 95 enables AND 98. This same coincidence condition enables AND 106 and causes failure counter 107 to increment one count. If a lean mixture is again sensed, immediately after resetting of latch 101, counter 107 will increment to the count of "two." Normally, while counter 107 may increment higher than a count one, this count never reaches a high count of, for example, "seven." For example, assume that toner is added three consecutive sensing intervals, each interval comprising an inhibit of two copy cycles as a result of operation of latch 101 and counter 103. Further assume that on the next sensing interval, feed latch 97 is not set on the occurrence of the next subsequent drum position pulse on conductor 95. In this event, AND 108 operates to reset counter 107 to its "zero" state.

However, in the event that counter 107 should ever increment to the count of "seven," then failure latch 109 is set, to generate a failure signal on conductor 110. This signal operates to inhibit the copying apparatus from further operation. The setting of this latch may, if desired, energize an indicator light such that subsequent operator attendance of the apparatus allows correction of the problem, whatever it may be, and, for example, a manual reset button may be depressed to generate a reset signal on conductor 111.

The operation of the present invention, as depicted in FIGS. 3 and 4, is preferably inhibited during cycle-up and/or cycle-down of the xerographic apparatus. That is, during the initial cycle-up movement of drum 12, during which the apparatus is being initialized in preparation to execute a copy request, and/or during the terminal cycle-down movement of the drum during which, for example, the drum is being cleaned and the final copy is being transported to exit tray 29, toner concentration is not sensed.

In addition, should the xerographic apparatus be of the type which operates to control developer 16 so that developer mix is physically presented to the photoconductor only when the photoconductor's area then passing through the developer includes a latent image, it is preferable to enable operation of the present invention only when the developer is enabled.

While the invention has been particularly shown and described with reference to preferred embodiments thereof, it will be understood by those skilled in the art that various changes in form and details may be made therein without departing from the spirit and scope of the invention.

What is claimed is:

1. Apparatus for maintaining toner concentration in an electrophotographic copying device, and for signaling failure of said apparatus, comprising:

toner concentration sensing means, toner supplying means controlled by said sensing means and operable to supply toner upon said sensing means sensing such a need;

failure sensing means controlled by said toner concentration sensing means and responsive to a prolonged time interval of sensing of the need to supply toner; and output means controlled by said failure sensing means and operable to provide a failure signal in the event that said prolonged time interval of sensing occurs.

2. The apparatus defined in claim 1 including inhibit means controlled by said toner concentration sensing means and operable to inhibit operation of said toner concentration sensing means for a predetermined interval immediately subsequent to said toner concentration sensing means indicating a need to supply toner.

3. The apparatus defined in claim 2 including means associated with said copying device to provide a copy cycle signal indicative of each cycle thereof, wherein said toner concentration sensing means generates a signal indicating a need to supply toner; and wherein said failure sensing means includes a counter which is incremented by the coincidence of said copy cycle signal and the presence of said need to supply toner signal, and is reset by the coincidence of said copy cycle signal and the absence of said need to supply toner signal.

4. The apparatus defined in claim 3 wherein said failure signal is operable to inhibit operation of said copying device.

5. Apparatus defined in claim 1, including:

copy cycle means associated with said copying device and operable to provide a unique signal indicative of each copy cycle thereof;

an inhibit counter enabled by said toner concentration sensing means upon said toner concentration sensing means generating a signal indicating a need to supply toner, and operable thereafter to count occurrences of said unique signal; and means controlled by the output of said inhibit counter to inhibit operation of said toner concentration sensing means for a predetermined number of copy cycles.

6. The apparatus defined in claim 5 wherein said output means comprises a failure counter which is incremented by said unique signal if said toner concentration sensing means generates a signal indicating a need to supply toner, and is reset by said unique signal if said toner concentration sensing means does not generate said signal.

7. The apparatus defined in claim 6 wherein said failure signal is operable to inhibit operation of said copying device.

8. A method of maintaining toner concentration in an electrophotographic copying apparatus having a developer, and for selectively inhibiting operation thereof, comprising the steps of:

sensing toner concentration;

supplying toner to said developer upon the sensing of low toner concentration;

sensing an abnormally long time interval of supplying toner; and generating a failure signal in the event that said abnormally long time interval is sensed.

9. The method defined in claim 8 wherein said sensing of toner concentration is substantially continuously performed, and including the step of inhibiting said sensing of toner concentration for a known short time interval following the step of supplying toner to said developer.

10. The method defined in claim 9 wherein the frequency at which toner is supplied is sensed, and said failure signal is generated in the event that said frequency reaches a predetermined high value.

11. The method defined in claim 10 wherein said failure signal is generated in response to a predetermined number of continuous steps of supplying toner, each step being spaced by no more than a said interval during which said sensing of toner is inhibited.

12. The method defined in claim 11 including the step of inhibiting operation of said copying apparatus upon generation of said failure signal.

13. In combination, a zerographic apparatus having a movable, reusable photoconductor adapted to recirculate through a developer to present latent images thereto to be toned by the developer's toner/carrier mix;

copy cycle means associated with photoconductor movement and operable to provide a copy cycle pulse for each image to be toned;

clock means providing a known number of clock pulses between adjacent copy cycle pulses;

toner concentration sensing means associated with said developer and providing a threshold sensed signal when toner concentration is low;

an integrating counter;

detecting means controlled by said clock means and operable to gate said threshold sensed signal into said integrating counter as a result of low toner concentration;

means connecting said copy cycle means to reset said integrating counter on the occurrence of each copy cycle pulse;

a feed latch connected to be set by said integrating counter if said integrating counter reaches a count at least as high as a predetermined number less than said known number of clock pulses;

add-toner output means, including said feed latch when set, operable to supply a unit quantity of toner to said developer; and inhibit means controlled by said add-toner output means and operable to inhibit operation of said toner concentration sensing means for a predetermined interval subsequent to the supplying of toner.

14. The combination defined by claim 13, wherein said inhibit means includes:

an inhibit latch connected to be set by said add-toner output means;

circuit means, responsive to said inhibit latch when set, operable to inhibit operation of aid toner concentration sensing means;

an inhibit counter connected to be enabled by said inhibit latch when set and operable to thereafter count said copy cycle pulses;

latch reset means, responsive to an output of said counter indicating that a predetermined number of copy cycle pulses have been counted, operable to reset said inhibit latch; and failure sensing means controlled by said feed latch when set.

15. The combination defined by claim 14 wherein said failure sensing means includes:

a failure counter connected to be controlled by said feed latch and to be incremented by a copy cycle pulse when said feed latch is set, and to be reset by a copy cycle pulse when said feed latch is not set; and failure output means, responsive to a predetermined count output of said failure counter, operable to generate a failure signal.

16. The combination defined by claim 15 wherein said failure signal is operable to inhibit operation of said xerographic apparatus.

17. Toner concentration control apparatus comprising:

a toner concentration sensor providing a cyclic output signal when a need to add toner is sensed;

an integrating counter connected to integrate said cyclic output signal and to provide an add-toner signal upon said integrating counter reaching a preset high-count state;

a periodic signal, of a frequency lower than said cyclic output signal, connected to reset said integrating counter;

inhibit means controlled by said add-toner signal and operable to inhibit operation of said toner concentration sensor for a preset interval; and a failure-sensing counter incremented by said add-toner signal and operable to provide a failure output when a preset number of said add-toner signals occurs in an interval spanning a number of said periodic signals.

18. The control apparatus defined in claim 17 including copying apparatus having a developer and toner dispensing means operable to add toner to said developer as a result of the occurrence of said add-toner signal, wherein said failure output is operable to inhibit operation of said copying apparatus.

19. The control apparatus defined in claim 18 wherein the frequency of said cyclic output signal is a function of the frequency with which toner concentration is sensed, and wherein the frequency of said periodic signal is a function of the rate at which copying apparatus produces copies.

20. The control apparatus defined in claim 17 wherein said inhibit means includes an inhibit counter which is enabled by said add-toner signal and is thereafter operable to count a preset number of periodic signals as a measure of said preset inhibit interval.

21. The control apparatus defined in claim 20 including copying apparatus having a developer and toner dispensing means operable to add toner to said developer as a result of the occurrence of said add-toner signal, wherein said failure output is operable to inhibit operation of said copying apparatus.

22. The control apparatus defined in claim 21 wherein the frequency of said cyclic output signal is a function of the frequency with which toner concentration is sensed, and wherein the frequency of said periodic signal is a function of the rate at which copying apparatus produces copies.

23. Toner concentration control apparatus for use with an electrophotographic copier apparatus having developer means operable to deposit toner on a latent electrostatic image carried by a photoconductor, comprising:

concentration sensing means operable to sense the quantity of toner within said developer means and to provide an add-toner output signal indicative of a need to add toner thereto;

toner supply means operable when activated to add toner to said developer means;

circuit means responsive to said add-toner signal and operable to actuate said toner supply means to add a unit quantity of toner to said developer means upon said concentration sensing means indicating such a need;

inhibit means controlled by said circuit means and operable upon actuation of said toner supply means to inhibit subsequent actuation of said toner supply means for M subsequent cycles of depositing toner on said electrostatic image; and failure detecting means controlled by said circuit means and operable upon actuation of said toner supply means N sequential times, each separated by no more than M cycles of depositing toner on said electrostatic image.

24. The toner concentration control apparatus defined in claim 23 wherein said failure detecting means is operable to inhibit operation of said copier.

25. A method of maintaining toner concentration in an electrophotographic copying apparatus having a developer and means to supply toner thereto from a toner supply of limited capacity, comprising the steps of:

sensing toner concentration in a manner which is capable of positively indicating that toner concentration is or is not below a given level;

supplying toner to said developer from said toner supply upon the sensing of toner concentration below said given level;

sensing an abnormally extended occasion of toner concentration below said given level, which may result from depletion of said toner supply or abnormal failure of the ability to sense that toner concentration is no longer below said given level; and generating a failure signal in the event that said abnormally extended occasion is sensed.

* * * * *